US008316564B2

(12) United States Patent
Sundhagen et al.

(10) Patent No.: US 8,316,564 B2
(45) **Date of Patent: *Nov. 27, 2012**

(54) EARTH LEVELING AND MOVING APPARATUS

(76) Inventors: Neal Sundhagen, Williston, ND (US); Shanon Sundhagen, Williston, ND (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/191,559

(22) Filed: Jul. 27, 2011

(65) Prior Publication Data

US 2011/0278032 A1 Nov. 17, 2011

Related U.S. Application Data

(63) Continuation of application No. 12/492,305, filed on Jun. 26, 2009, now Pat. No. 8,056,271.

(51) Int. Cl.
*B62B 1/00* (2006.01)

(52) U.S. Cl. ..... 37/434; 172/42; 172/329

(58) Field of Classification Search ..... 37/196, 37/266, 269, 272, 434; 172/42, 329; 56/DIG. 18; D8/1, 10; 294/49, 54.5; D34/16, 27; 298/3; 280/47.31, 653

See application file for complete search history.

(56) References Cited

U.S. PATENT DOCUMENTS 2,433,019 A * 12/1947 Arps ..... 37/408
2,715,786 A * 8/1955 Dorko ..... 37/283
2,967,363 A * 1/1961 Meier ..... 37/283
3,773,112 A * 11/1973 Zinck ..... 172/42
3,773,575 A * 11/1973 Sayles ..... 149/22
4,048,735 A * 9/1977 Brunty ..... 37/434
4,176,828 A * 12/1979 Lange ..... 266/65
4,179,828 A 12/1979 Brunty
4,264,095 A * 4/1981 Lemasters ..... 294/53.5
4,357,728 A * 11/1982 Pravettone ..... 15/257.4
4,442,567 A * 4/1984 Pravettone ..... 15/257.4
4,910,893 A * 3/1990 Asay ..... 37/281
5,511,328 A * 4/1996 Fingerer et al. ..... 37/285
5,842,336 A * 12/1998 Chiu ..... 56/400.02
5,915,431 A * 6/1999 Doussan ..... 15/1.7
6,152,240 A * 11/2000 Nonhoff et al. ..... 172/311
6,155,620 A * 12/2000 Armstrong ..... 294/57
6,457,757 B2 * 10/2002 Hendrick ..... 294/54.5
6,474,007 B1 * 11/2002 Sueshige et al. ..... 37/266
7,730,643 B2 * 6/2010 Mishra et al. ..... 37/266

* cited by examiner

*Primary Examiner* — Jamie L McGowan
(74) *Attorney, Agent, or Firm* — Husch Blackwell LLP

(57) ABSTRACT

An earth leveling and moving apparatus designed to move and level dirt and is compact for getting into tight areas that are needed to be reached for landscaping and other similar purposes. The apparatus includes a handle assembly, a blade assembly, a blade coupled to the blade assembly, a basket and two wheel assemblies. The handle assembly is connected to the blade assembly which is coupled to the blade. The blade may be removable and may have a straight edge or a ripper edge with teeth for cutting through hard surfaces. The basket is coupled to the handle assembly and to two wheel assemblies. The blade height is determined by adjusting the wheel assemblies and varying the force used on the handle assembly. The basket may have materials for weight in order to aid in applying a downward force to cut or gouge the land and level the land as the user desires. The basket may also be used to move debris and materials around the worksite.

9 Claims, 7 Drawing Sheets

EARTH LEVELING AND MOVING APPARATUS

CROSS-REFERENCE TO RELATED APPLICATIONS

This Application is a Continuation of and claims priority to U.S. application Ser. No. 12,492,305 filed Jun. 26, 2009 now U.S. Pat. No. 8,056,271 to Neal Sundhagen and Shanon Sundhagen entitled "Earth Leveling And Moving Apparatus," the entire disclosure of which is hereby incorporated by reference to the extent permitted by law.

BACKGROUND OF THE INVENTION

In the landscaping business, other yard-type businesses, construction work and other similar business, it is often important to move dirt around easily. In light thereof, different machinery is commonly used in these types of businesses to move dirt around, level ground and perform other such tasks. A common machine used is a skid-steer loader which is a rigid frame, engine-powered machine with lift arms used to attach a wide variety of labor-saving tools or attachments. Though sometimes equipped with tracks, skid-steer loaders are typically four-wheel drive vehicles with the left-side drive wheels independent of the right-side drive wheels. Skid-steer loaders are capable of zero-radius "pirouette" turning which makes them extremely maneuverable and valuable for applications that require a compact, agile loader in limited but still large spaces. Even though they are relatively small and compact, skid-steer loaders are bulky and are not easily maneuverable in small spaces. It is also difficult to maneuver such machines on certain types of terrain, uneven ground and terraces. Therefore, it would be beneficial to provide an apparatus that has the ability to move and level dirt easily but is also portable and small enough to fit in spaces wherein a skid-steer loader or other bulkier machinery cannot fit or is not practical to use. Therefore, it would also be beneficial to provide an apparatus that is easily maneuverable on a variety of terrains including uneven ground, terraces, and snowy or snow-covered ground.

SUMMARY OF THE INVENTION

The present invention is directed to an earth moving apparatus designed for moving and leveling dirt and is compact for getting into tight areas that are needed to be reached for landscaping and other similar purposes. The earth leveling and moving apparatus hereof includes a handle assembly, a blade assembly, a blade coupled to the blade assembly, a basket, and two wheel assemblies. The handle assembly is connected to the blade assembly which is coupled to the blade. The blade may be removable and may have a straight edge or a ripper edge with teeth for cutting through compacted dirt and other hard surfaces. The blade height is determined by adjusting the wheel assemblies and varying the force used on the handle assembly. The basket is coupled to the handle assembly and to two wheel assemblies. The basket may have dirt or other heavy materials such as, for example, rock, brick, or concrete, to provide adjustable ballast to the apparatus to aid in leveling the land as the user desires.

Other and further objects of the invention, together with the features of novelty appurtenant thereto, will appear in the course of the following description.

BRIEF DESCRIPTION OF THE SEVERAL VIEWS OF THE DRAWING

In the accompanying drawings, which form a part of the specification and are to be read in conjunction therewith in which like reference numerals are used to indicate like or similar parts in the various views.

DETAILED DESCRIPTION OF THE INVENTION

Figure 1:
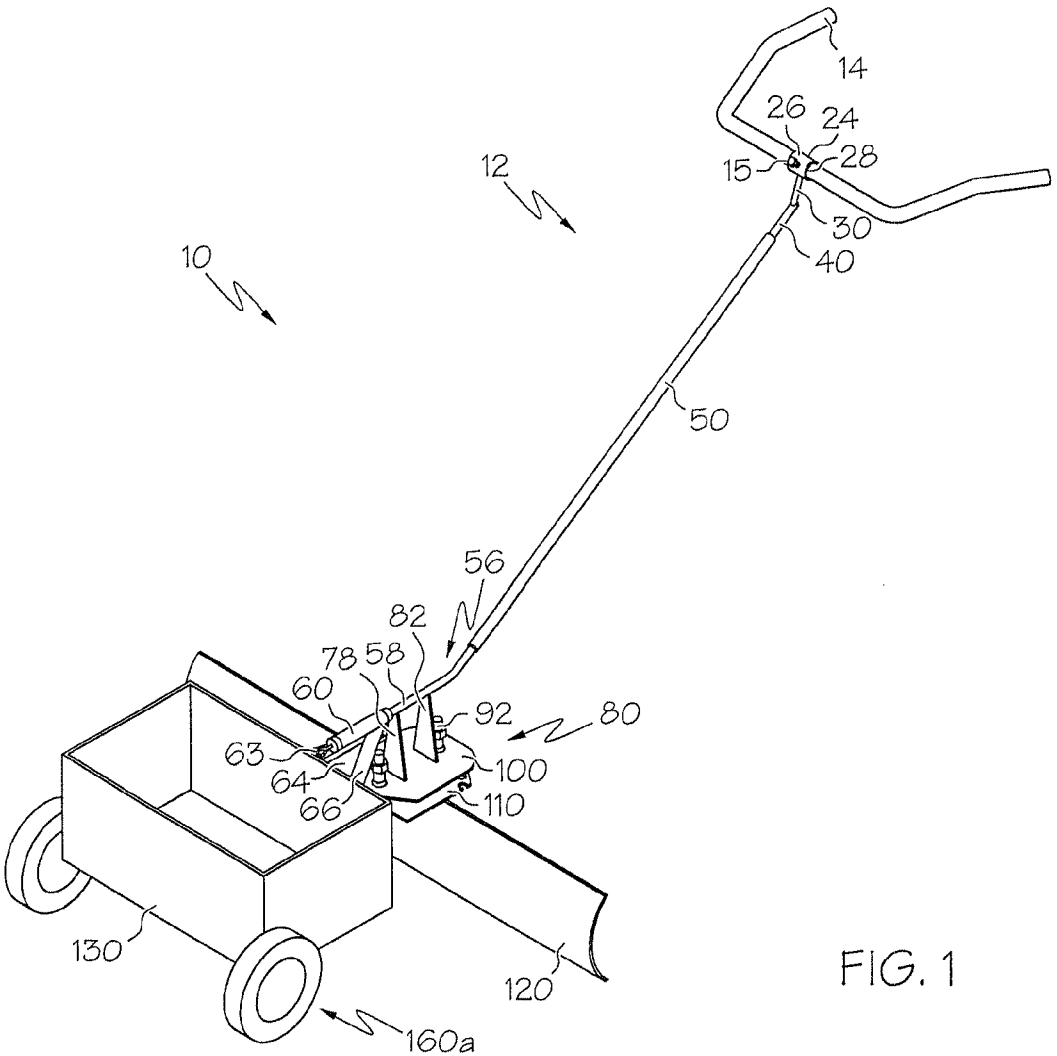
FIG. 1 is a front perspective view of one embodiment of the earth leveling and moving apparatus of the present invention.

Apparatus 10 embodying various features of the present invention is shown in the drawings. In a first embodiment, as shown in FIG. 1, an earth leveling and moving apparatus 10 generally includes a handle assembly 12 affixed to a blade assembly 80, a blade 120 removably coupled to blade assembly 80, a basket 130 removably coupled to blade assembly 80, and wheel assemblies 160*a* and 160*b* coupled to basket 130. Apparatus 10 is used for landscaping, ground leveling, other yard tasks and snow or ice removal. Apparatus 10 is portable, can fit into smaller areas than larger machines, and is configured to be either pushed or pulled. A user grasps handle assembly 12 and can either push or pull apparatus 10. Apparatus 10 is ideal for leveling dirt in a variety of spaces and terrain. In order to achieve the desired level of the ground, blade 120 is adjusted by adjusting the height of wheel assemblies 160*a* and 160*b*. Blade 120 may also be adjusted by use of handle assembly 12. In addition or alternatively, basket 130 can have various materials added to it to weigh apparatus 10 down thereby adjusting the ballast of apparatus 10, such as, for example, water, sand, dirt, concrete, rock, brick cinder blocks, or other debris. Once the desired level and/or angle of blade 120 is achieved, the user pushes or pulls apparatus 10 around the space where leveling the dirt is desired. Blade 120 will either pull or push the dirt until a level and smooth surface is achieved. Blade 120 determines the direction that the dirt gets moved. Blade 120 may be adjusted at various angles to fit in a desired space or for a specific job. Blade 120 may also be removed and replaced with different types of blades, such as a ripper blade with teeth, as illustrated herein, to aid in ice or packed snow removal. Apparatus 10 is easily maneuverable on a variety of terrains including uneven ground, terraces, packed snow, or hard ground. It is a valuable tool for any landscaper, novice gardener, city street worker, or oil field site worker. Basket 130 may also be used to haul excessive dirt to another location and is ideal for moving dirt, bushes, plants and other yard and landscaping debris around easily.

Figure 3:
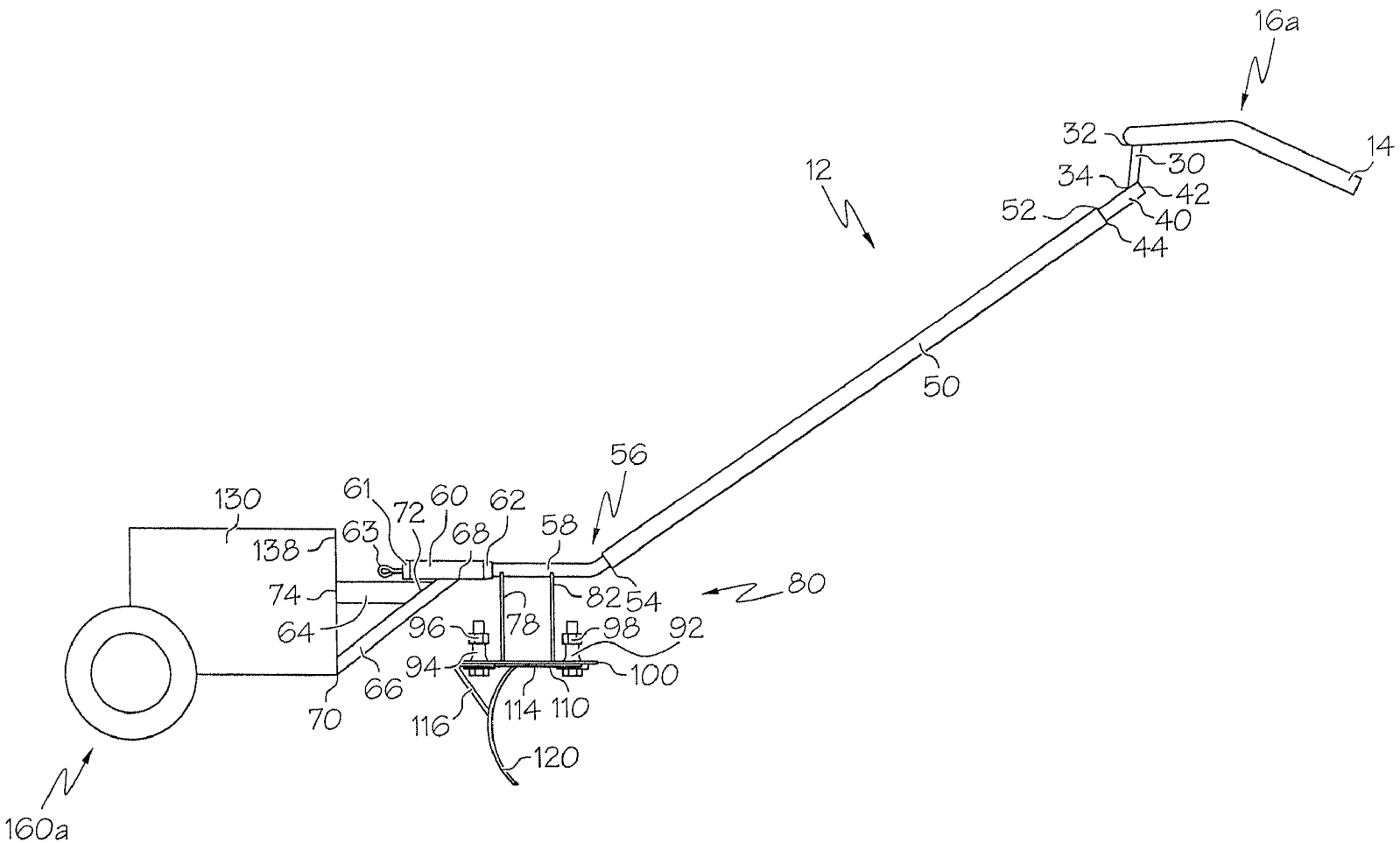
FIG. 3 is a left side elevational view of the apparatus of FIG. 1.
Figure 4:
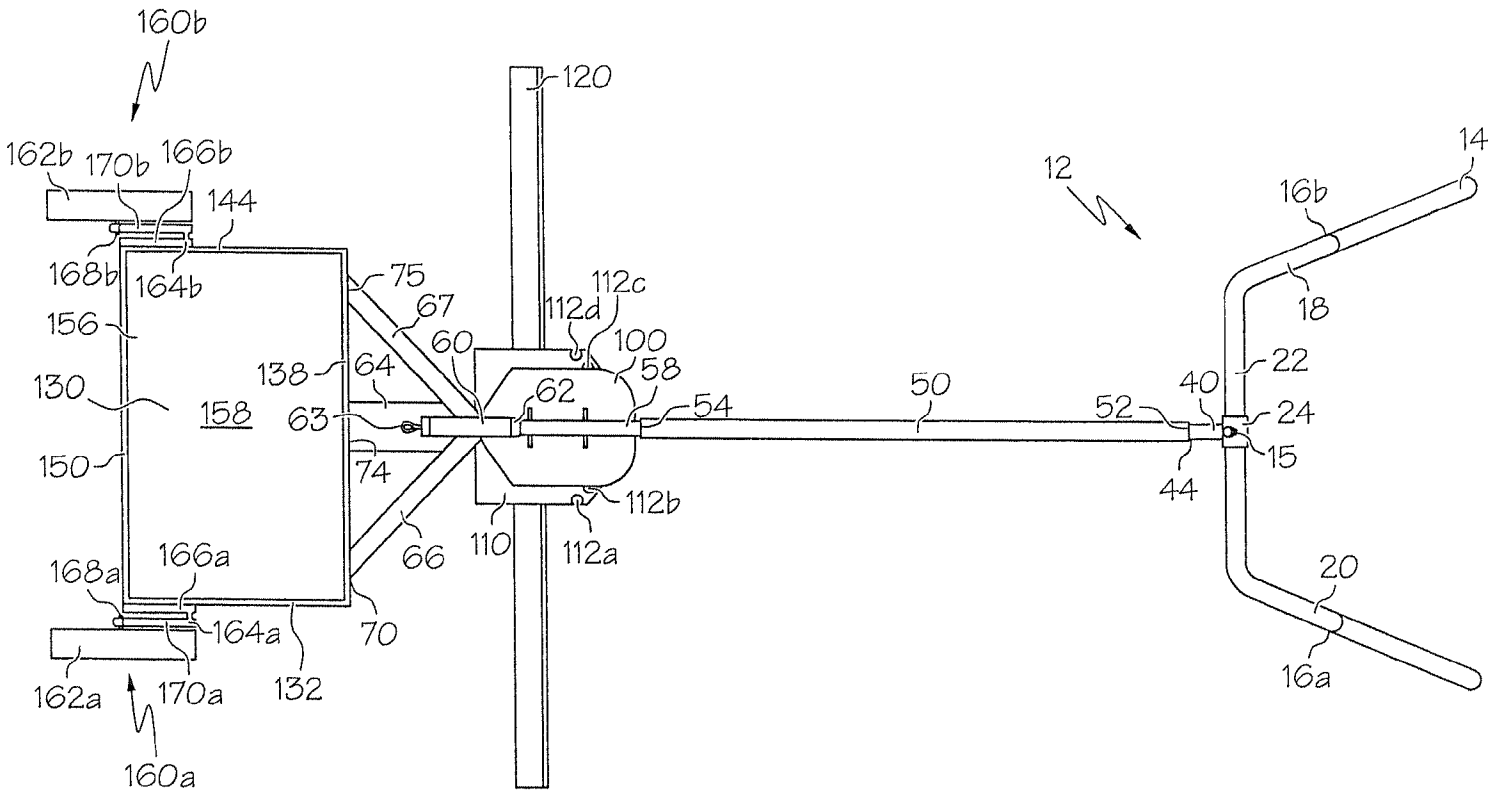
FIG. 4 is a top plan view of the apparatus of FIG. 1.
Figure 5:
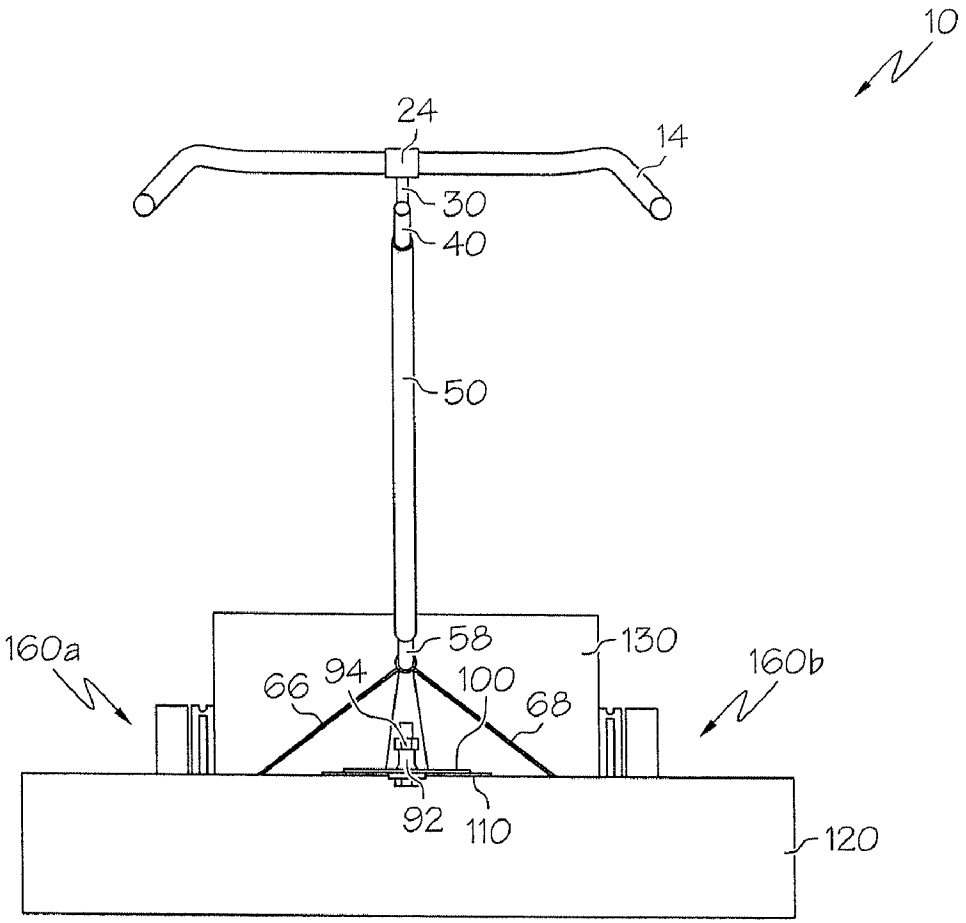
FIG. 5 is a rear elevational view of the apparatus of FIG. 1.

As illustrated in FIGS. 1, 3 and 4, handle assembly 12 includes, a handle 14, an adjustment bolt 15, a band 24, an adjustment bolt 15, a first shaft 30, a second shaft 40, a body 50, an arm 58, a swivel joint 60, a bushing 61, and a pin 63. Handle 14 is generally cylindrical and can have a multiplicity of shapes such as U-shaped, T-shaped, or V-shaped. It will be appreciated by one skilled in the art that any of these or other appropriate shapes may be used for the shape of handle 14. Throughout this disclosure, handle 14 is generally U-shaped and includes a bar 22 with two arms 18, 20 extending outwardly therefrom at an approximate 120-degree angle from bar 22. Each arm 18, 20 has a slight bend 16*a*, 16*b* respectively proximate the middle of each arm 18, 20. Handle 14 is generally parallel to the ground but may have a slight angle downward at bends 16*a*, 16*b* as shown in FIG. 3. Adjustment bolt 15 is removeably coupled to band 24 and may be adjusted in order to adjust handle 14 up or down for the comfort and height of the user. Band 24 is generally cylindrical and includes an inner surface 28 and an outer surface 26. Inner surface 28 is coupled to handle 14 proximate the center of bar 22. First shaft 30 is generally cylindrical and has a first end 32 and a second end 34 at opposing ends of first shaft 30. First shaft 30 is affixed at first end 32 to outer surface 26 of band 24 at approximately a 90-degree angle from bar 22. Second shaft 40 is generally cylindrical and has a first end 42 and a second end 44. Second shaft 40 is coupled to first shaft 30 at second end 34 of first shaft 30 and first end 42 of second shaft 40 such that first shaft 30 and second shaft 40 form approximately a 45-degree angle. Body 50 is generally cylindrical and has a first end 52 and an opposing second end 54 and is coupled to second end 44 of second shaft 40 at first end 52. Body 50 is generally angled from the ground at about a 45-degree angle in order to give leverage to the lower part of apparatus 10. Body 50 is coupled to arm 58 at second end 54. A bend 56 in arm 58 is at approximately 45-degree angle and is opposite a coupling 62. Coupling 62 is attached to swivel joint 60 that, when turned, allows blade assembly 80 to be tilted by operator as is needed to move or shape dirt. Arm 58 is coupled to swivel joint 60 at coupling 62. Swivel joint 60 is coupled to bushing 61 that is removeably attached to pin 63. Pin 63 allows handle assembly 12 to be disconnected from basket 130. It will be appreciated by one skilled in the art that pin 63 may be a clevis pin, a nut and bolt system, a latch, a clip, or other appropriate fastening system now known or hereinafter developed.

Figure 7:
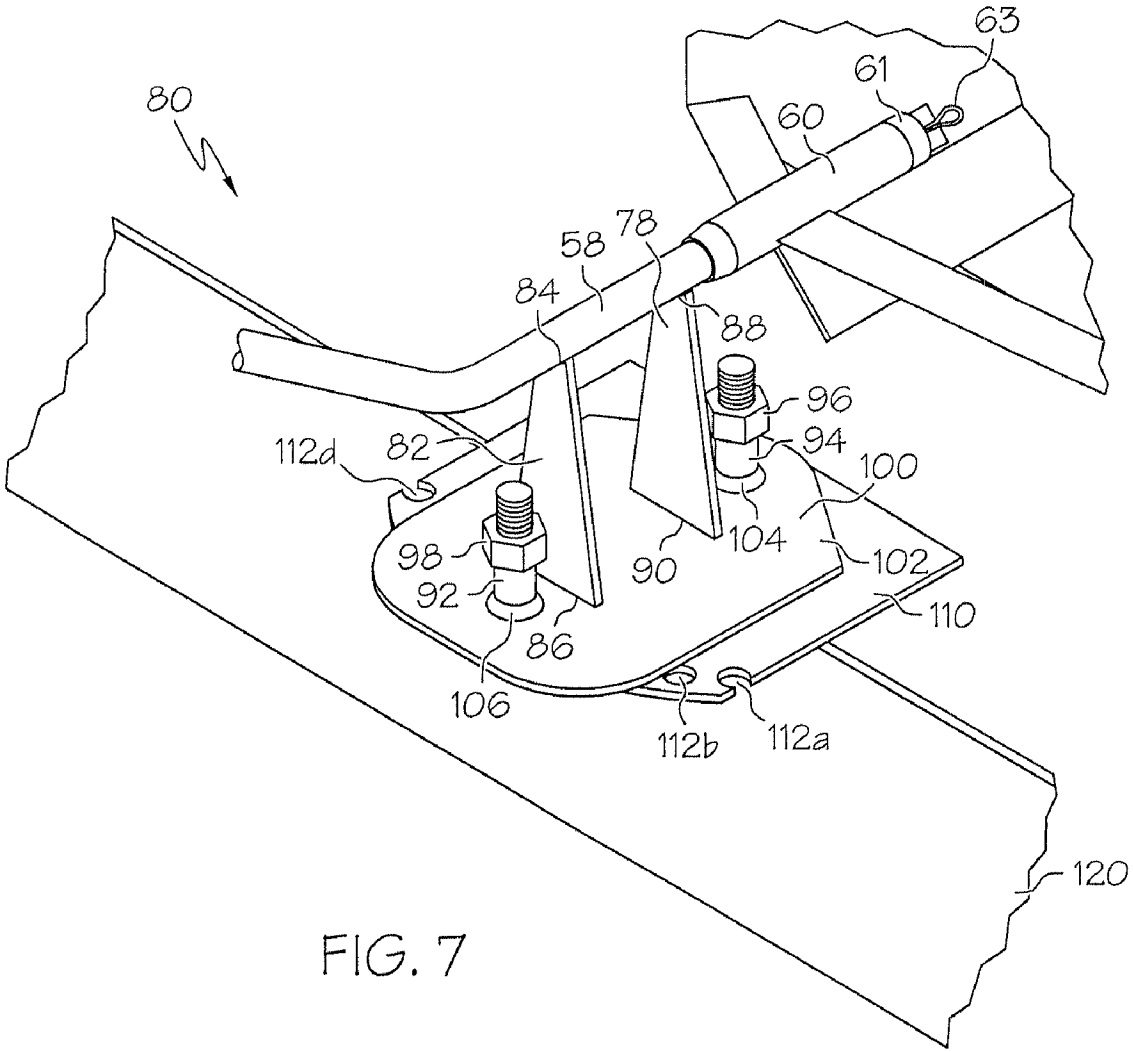
FIG. 7 is a rear perspective view of the blade assembly of the apparatus of FIG. 1 or 6.

Illustrated in FIGS. 3 and 4 is blade assembly 80 and blade 120 attached to blade assembly 80. More specifically, FIG. 7 illustrates a rear perspective view of blade assembly 80. Blade assembly 80 includes legs 78 and 82, attachment plate 100, pivot plate 110 and fasteners 92 and 94. Legs 78 and 82 each have a first end 88, 84, respectively, and an opposing second end 90, 86, respectively. Second ends 90, 86 are generally wider than first ends 88, 84. First ends 88, 84 are perpendicularly attached to arm 58 and are approximately 3-5 inches apart. Second ends 90, 86 are perpendicularly attached to a face 102 of attachment plate 100. Attachment plate 100 defines at least two apertures 104, 106 therethrough for receiving fasteners 94, 92, respectively. Pivot plate 110 defines at least two apertures (not shown) therethrough for receiving fasteners 94, 92. Pivot plate 110 also defines apertures 112*a*, 112*b*, 112*c*, and 112*d* therethrough for receiving fastener 92. Fastener 94 allows pivot plate 110 to be coupled to attachment plate 100 such that pivot plate 110 can pivot around fastener 94 in order to adjust blade 120, horizontally. Fastener 94 may be a bolt with a nut 96 coupled to fastener 94 for securely fastening attachment plate 100 to pivot plate 110. It will be appreciated by one skilled in the art that a nut and bolt system may be used or other appropriate fasteners may be used such as, for example, a lug, a latch, or other appropriate fastener now known or hereafter developed that may be used to secure attachment plate 100 and pivot plate 110 together while allowing pivot plate 110 to pivot around fastener 94. Blade 120 is removably coupled to a bottom face 114, shown in FIG. 3, of pivot plate 110. Pivot plate 110 may have a member 116 that extends downward by approximately a 120-degree angle from pivot plate 110. Member 116 may be fixed to blade 120 or may just rest on blade 120. Member 116 is optional and configured to aid in structure support and stability but is not necessary. Pivot plate 110 may be pivoted around fastener 94 in a variety of positions. In order to move pivot plate 110 and therefore blade 120 to different positions, pivot plate 110 is moved by the user to the desired location and then fastener 92 and bolt 98 is used to secure pivot plate 110 in that location. Pivoting blade 120 aids the user in shaping the landscape and moving dirt to the desired location. In an alternate embodiment, blade 120 is fixed by welding to pivot plate 110. Blade 120 may be a straight blade (not shown) or have a concave shape as shown in FIG. 3.

FIGS. 3 and 4 illustrate the connection of basket 130 to handle assembly 20. Basket 130 has an open box configuration and includes four side walls 150, 138, 132 and 144 and a bottom wall 158. Shown in FIG. 3, a first beam 66 is coupled to swivel joint 60 at attachment point 68 so that first beam 66 extends from swivel joint 60 at a 45-degree angle from the ground and a 45-degree angle from the plane in which swivel joint 60 lies. First beam 66 has an end 70 that is opposite attachment point 68 and end 70 is coupled to rear wall 138 of basket 130. A second beam 64 is coupled to first beam 66 at a 45-degree angle 72 to first beam 66 and is parallel to swivel joint 60. Second beam 64 has an end 74 that is opposite angle 72 and second beam 64 is coupled to rear wall 138 of basket 130. FIG. 4 illustrates similar coupling as first beam 66 between a third beam 68, swivel joint 60 and second beam 64. First beam 66 and third beam 68 are at a 90-degree angle from each other. Third beam 67 has an end 75 that is opposite attachment point 68 and end 75 is coupled to rear wall 138 of basket 130. Basket 130 may be used for moving and hauling dirt or other landscaping debris easily. Water, sand, or concrete blocks can be added to the basket to add weight to apparatus 10 and give the desired down force to blade 120 via basket 130.

Figure 2:
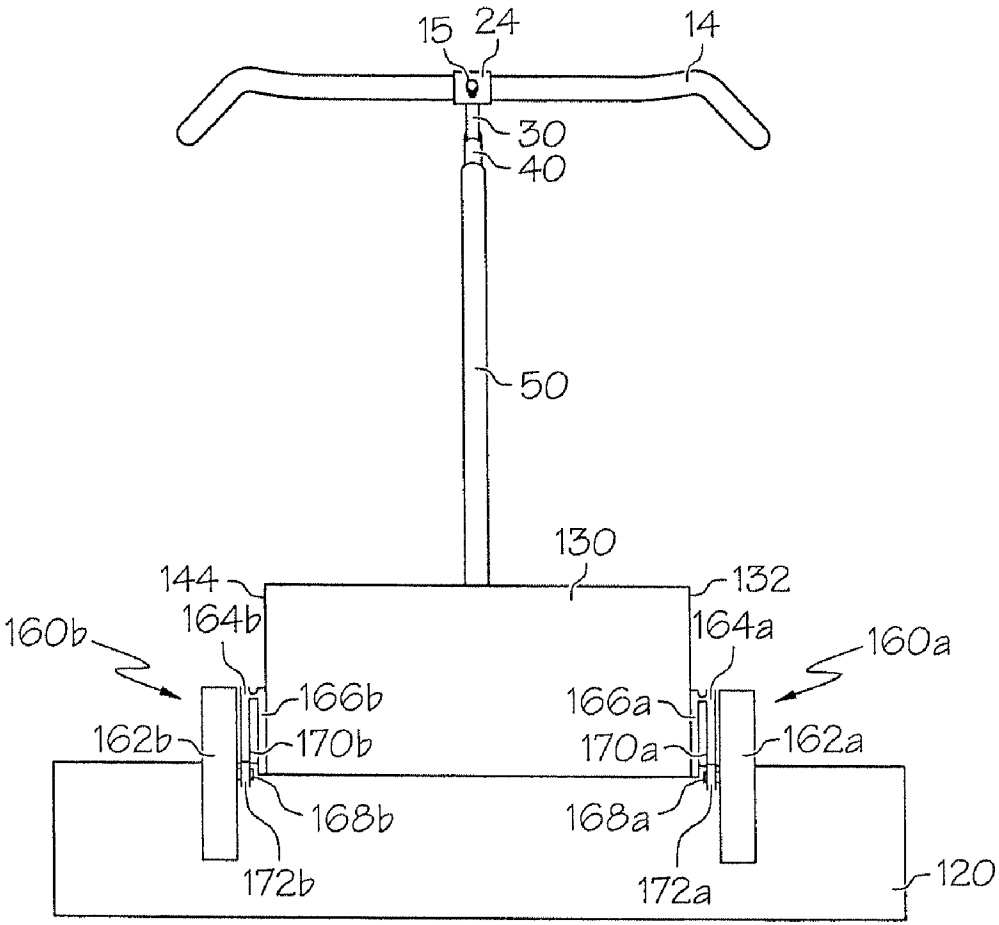
FIG. 2 is a front elevational view of the apparatus of FIG. 1.

Illustrated in FIG. 2 are adjustable height wheel assemblies 160*a*, 160*b*. Wheel assembly 160*a* includes a wheel 162*a*, an adjustable U-joint 164*a*, a yoke 172*a*, and a fastener 168*a*. U-joint 164*a* generally has two legs 166*a*, 170*a* extending outwardly. Inner leg 166*a* is coupled to left sidewall 132. Inner leg 166*a* is flush with bottom wall 158 of basket 130. Outer leg 170*a* is coupled to yoke 172*a* at the non-jointed end of leg 170*a*. Yoke 172*a* defines an aperture (not shown) configured for receiving a fastener to rotatably secure wheel 162*a* to yoke 172*a*. Wheel assembly 160*b* is fashioned in the same manner as wheel assembly 160*a* except that inner leg 166*b* is coupled to left sidewall 144. In FIG. 4, an alternate positioning of wheel assemblies 160*a*, 160*b* is shown where wheel assemblies 160*a*, 160*b* are rotated by approximately 90-degrees. It will be appreciated by one skilled in the art that any appropriate shape for the U-joint may be used. It will be further appreciated by one skilled in the art that any appropriate wheel assembly may be used such as a bar rotatably connected to basket 130 with two wheels on opposing ends. The length of adjustable U-joints 164*a*, 164*b* may be adjusted in order to vary the lengths of wheel assemblies 160*a*, 160*b*.

In a second embodiment (not shown), first shaft 30, second shaft 40, body 50, arm 58, coupling 62, and swivel joint 60 are all part of one shaft with the same general shape including having a 45-degree angle that corresponds to the angle formed at the connection of first shaft 30 and second shaft 40 and having another 45-degree angle that corresponds to bend 56.

Figure 6:
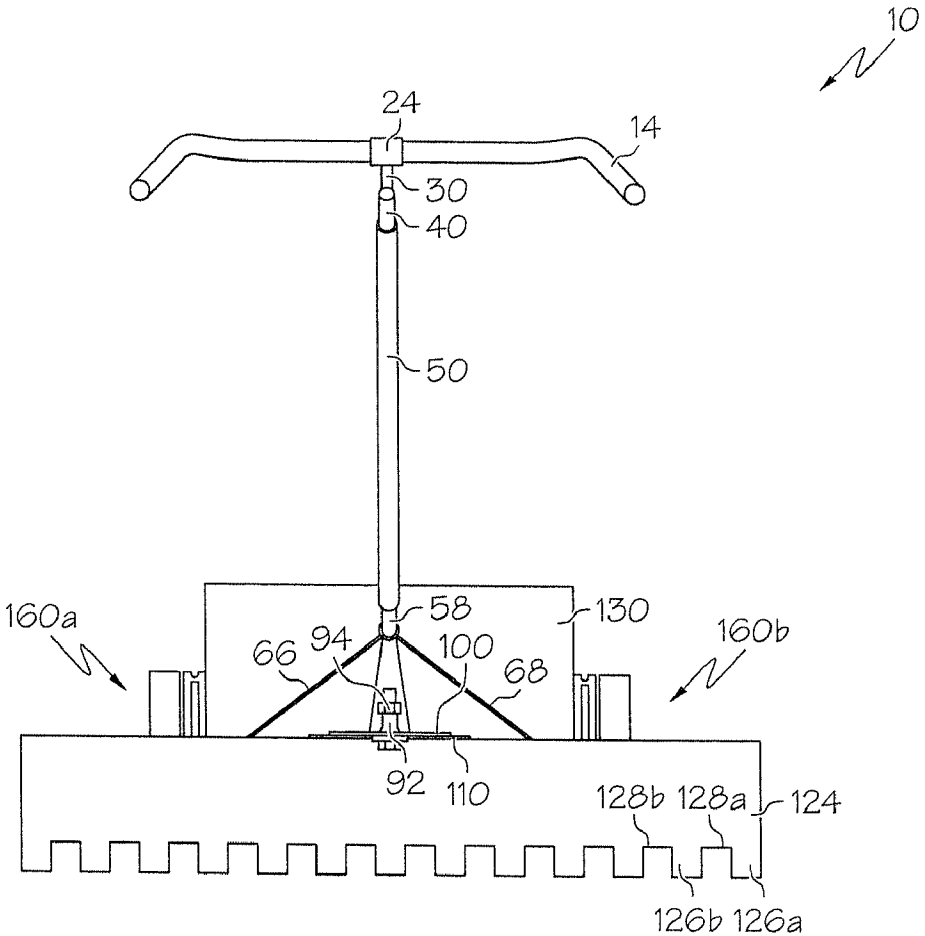
FIG. 6 is a rear elevational view of an alternate embodiment of the earth moving apparatus of the present invention.

In a third embodiment, shown in FIG. 6, a ripper blade 124 is attached. Ripper blade 124 has teeth 126*a*, 126*b* that define a space 128*a* in between. Teeth 126*a*, 126*b* alternate with spaces 128*a*, 128*b* depending on how many teeth are needed for the blade length being used. Ripper blade 124 may be used for cutting through snow packed and other hard surfaces.

In a fourth embodiment (not shown), apparatus 10 is constructed in a similar manner as described hereinabove and shown in FIGS. 1-5 and 7, except that an additional arm extends from front wall 150 of basket 130 and blade assembly

80 is coupled to the additional arm. This creates a position of having blade 120 on the front of the apparatus rather than having blade 120 located behind basket 130, as shown in FIGS. 1-6.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A dirt moving apparatus comprising:

a handle assembly having a first end and a second end, said handle assembly including a handle proximate said first end;

a basket operably connected to said second end of said handle assembly, said basket having a bottom, said bottom having a front, a back, a first side and a second side;

a first wheel assembly operably connected to said basket proximate said first side and said front of said bottom and a second wheel assembly operably connected to said basket proximate said second side and said front of said bottom;

a blade mounting assembly coupled to said handle assembly proximate said second end of said handle assembly; and a downwardly extending blade removeably coupled to said blade mounting assembly, said blade disposed between said wheel assemblies and said handle;

wherein said blade mounting assembly comprises a first leg and a second leg, wherein said first leg and said second leg each have a first end and an opposing second end, wherein said second ends are coupled to an attachment plate, said blade assembly further comprising a pivot plate removably coupled to said attachment plate, wherein said attachment plate includes a first aperture therethrough proximate a back edge of said attachment plate and a second aperture therethrough proximate a front edge of said attachment plate, and wherein said pivot plate includes a first aperture therethough proximate a back edge of said pivot plate and a second aperture therethrough proximate a front edge of said pivot plate, said first apertures of said attachment plate and said pivot plate being substantially aligned for receiving a first fastener and said second apertures of said attachment plate and said pivot plate being substantially aligned to receive a second fastener, and wherein said pivot plate is generally parallel to and coupled to said attachment plate by said first and second fasteners.

2. The apparatus of claim 1 wherein said first and second legs are quadrilateral and said second ends of said first leg and said second leg are wider than said first ends of said first leg and said second leg.

3. The apparatus of claim 1 wherein said fasteners are selected from the group consisting of a bolt, a lug, a latch, a pin and a key.

4. The apparatus of claim 1 wherein said pivot plate includes at least two additional apertures therethrough for receiving said second fastener, wherein said additional apertures are located adjacent to said second aperture and wherein said additional apertures and said second aperture are radially equidistant from said first aperture.

5. The apparatus of claim 1 wherein said blade is concave.

6. The apparatus of claim 1 wherein said handle assembly, said blade assembly, and said basket are each made from a material selected from the group consisting of metal, steel, aluminum, alloy, wood plastic, composite laminate, fiberglass, and graphite.

7. A dirt moving apparatus comprising:

a handle assembly having a first end and a second end, said handle assembly including a handle proximate said first end;

a basket operably connected to said second end of said handle assembly, said basket having a bottom, said bottom having a front, a back, a first side and a second side;

a first wheel assembly operably connected to said basket proximate said first side and said front of said bottom and a second wheel assembly operably connected to said basket proximate said second side and said front of said bottom;

a blade mounting assembly coupled to said handle assembly proximate said second end of said handle assembly; and a downwardly extending blade removeably coupled to said blade mounting assembly, said blade disposed between said wheel assemblies and said handle;

wherein the said first and second wheel assemblies include a wheel and a height adjustment mechanism, said height adjustment mechanism operably connected to said wheel and configured to provide varying heights between said bottom of said basket and a surface below; and wherein said height adjustment mechanism comprises an adjustable U-joint wherein said U-joint includes a first leg and a second leg extending perpendicularly from a bar at opposing ends of said bar, said first leg operably coupled to said wheel, said second leg coupled to said basket, wherein a relative position of said first leg and said second leg may be adjusted by pivoting one or more of said legs about said bar and wherein the relative position may be fixed by a locking mechanism configured to temporarily fix the relative position of said first and second legs.

8. A dirt moving apparatus comprising:

a handle assembly having a first end and a second end, said handle assembly including a handle proximate said first end;

a basket operably connected to said second end of said handle assembly, said basket having a bottom, said bottom having a front, a back, a first side and a second side;

a first wheel assembly operably connected to said basket proximate said first side and said front of said bottom and a second wheel assembly operably connected to said basket proximate said second side and said front of said bottom;

a blade mounting assembly coupled to said handle assembly proximate said second end of said handle assembly;

a downwardly extending blade removeably coupled to said blade mounting assembly, said blade disposed between said wheel assemblies and said handle; and an arm coupled to and extending outwardly from a front of said basket, wherein a second blade assembly is coupled to said arm and wherein a second downwardly extending blade is removably coupled to said second blade assembly;

wherein said blade assembly comprises a first leg and a second leg, wherein said first leg and said second leg each have a first end and an opposing second end, wherein said second ends are coupled to a second attachment plate, said second blade assembly further comprising a second pivot plate removably coupled to said second attachment plate, wherein said second attachment plate includes a first aperture therethrough proximate a back edge of said second attachment plate and a second aperture therethrough proximate a front edge of said second attachment plate, and wherein said second pivot plate includes a first aperture therethough proximate a back edge of said second pivot plate and a second aperture therethrough proximate a front edge of said second pivot plate, said first apertures of said second attachment plate and said second pivot plate being substantially aligned for receiving a first fastener and said second apertures of said second attachment plate and said second pivot plate being substantially aligned to receive a second fastener, and wherein said second pivot plate is generally parallel to and coupled to said second attachment plate by said first and second fasteners.

9. A dirt moving apparatus comprising:

a handle assembly having first end and a second end, said handle assembly including a handle proximate said first end;

a basket operably connected to said second end of said handle assembly, said basket having a bottom, said bottom having a front, a back, a first side and a second side;

a first wheel assembly operably connected to said basket proximate said first side and said front of said bottom and a second wheel assembly operably connected to said basket proximate said second side and said front of said bottom;

a blade mounting assembly coupled to said handle assembly proximate said second end of said handle assembly;

a downwardly extending blade removeably coupled to said blade mounting assembly, said blade disposed between said wheel assemblies and said handle;

wherein said handle assembly comprises substantially cylindrical members and comprises said handle having an outer surface coupled to an inner surface of a band proximate a center of said handle, a first shaft perpendicularly coupled to an outer surface of said band, a second shaft having a first end and an opposing second end wherein said first end is coupled to said first shaft at an opposing end to said band and at about a forty-five degree angle from said first shaft, a body having a first end and a second end wherein said first end of said body is coupled to said second end of said second shaft, a coupling arm having opposing first and second ends and about a forty-five degree bend in said arm wherein said second end of said body is coupled to said first end of said arm, and said basket is operably connected to said second end of said coupling arm;

wherein said basket is operably coupled to said coupling arm with a swivel joint, said swivel joint configured to allow relative rotation of said basket and said coupling arm about a substantially horizontal longitudinal axis of said coupling arm; and a bracing link system operably connecting said basket to said swivel joint;

wherein said bracing link system comprises a first beam, a second beam, and a third beam wherein said first beam has a first end and a second end, said first end of said first beam being coupled to said swivel joint and extending downwardly and outwardly toward and coupled to the basket proximate the first wall and said bottom of said basket, said third beam having a first end and a second end, said first end of said third beam coupled to said swivel joint and extending downwardly and outwardly toward wherein said second end of said third beam is coupled to said basket proximate said second wall and said bottom of said basket, said second beam having a first end and a second end, said first end coupled to both said first beam and said third beam proximate said swivel joint and said second beam extending substantially horizontal wherein said second end of said second beam is coupled to said basket.

* * * * *